US005244504A

United States Patent [19]

Watson

[11] Patent Number: 5,244,504

[45] Date of Patent: Sep. 14, 1993

[54] LOOM REED CLEANING METHOD AND APPARATUS

[75] Inventor: Scott W. Watson, Piedmont, S.C.

[73] Assignee: Milliken Research Corporation, Spartanburg, S.C.

[21] Appl. No.: 690,471

[22] Filed: Apr. 24, 1991

Related U.S. Application Data

[62] Division of Ser. No. 618,067, Nov. 26, 1990.

[51] Int. Cl.[5] ..... D03D 49/00

[52] U.S. Cl. ..... 134/21; 15/302; 139/1 C

[58] Field of Search ..... 134/21, 36; 139/1 C; 15/302, 301, 309.1

[56] References Cited

U.S. PATENT DOCUMENTS 1,375,663 4/1921 Ainsworth .

3,545,029 6/1988 Walmsley et al. ..... 134/21

4,854,004 8/1989 Omata et al. ..... 15/304

4,964,441 10/1990 Long et al. ..... 15/302

FOREIGN PATENT DOCUMENTS 0259577 8/1988 German Democratic Rep. ... 134/21

*Primary Examiner*—Harvey C. Hornsby

*Assistant Examiner*—Reginald L. Alexander

*Attorney, Agent, or Firm*—Earle R. Marden; Terry T. Moyer

[57] ABSTRACT

Method and apparatus to employ high pressure air to blow the lint, trash, etc. from the reed of a weaving machine in an efficient manner. The apparatus has a plurality of wheels thereon which engage the reed and allow the cleaning head to be readily slid across the loom to project the high pressure air against and through the dents of the reed.

2 Claims, 3 Drawing Sheets

*FIG. –1–*

LOOM REED CLEANING METHOD AND APPARATUS

This is a division of application Ser. No. 618,067 filed Nov. 26, 1990 for LOOM REED CLEANING METHOD AND APPARATUS.

This invention relates generally to the cleaning of reeds and in particular to the cleaning of air jet loom reeds while in position on the loom without disengaging the warp yarn therefrom.

It is necessary for efficient operation of a weaving machine to clean the lint, finish, etc. from on and between the dents of a loom reed. This, in the past has been accomplished in numerous ways, none of which are completely satisfactory. The obvious and old fashioned way to clean the reed was to disengage the warp yarns and remove the reed to a remote position for cleaning. This was very time consuming and inefficient. Some practical systems such as leaving the reed in the loom and blowing or ultrasonically treating the reed in situ have been tried but do not perform the necessary cleaning in the most efficient manner.

Therefore, it is an object of this invention to provide an apparatus and method to efficiently clean the reed of a weaving machine in situ without disengaging the warp yarns therefrom.

Other objects and advantages of the invention will become readily apparent as the specification proceeds to describe the invention with reference to the accompanying drawings, in which.

In the preferred form of the invention the reed cleaning apparatus is disclosed in conjunction with an air jet weaving machine with the warp yarns located in weaving position but obviously the herein-disclosed system could be used on water jet, rapier, fly shuttle, etc. weaving machine and if desired could be used to clean reeds off-loom.

Figure 1:
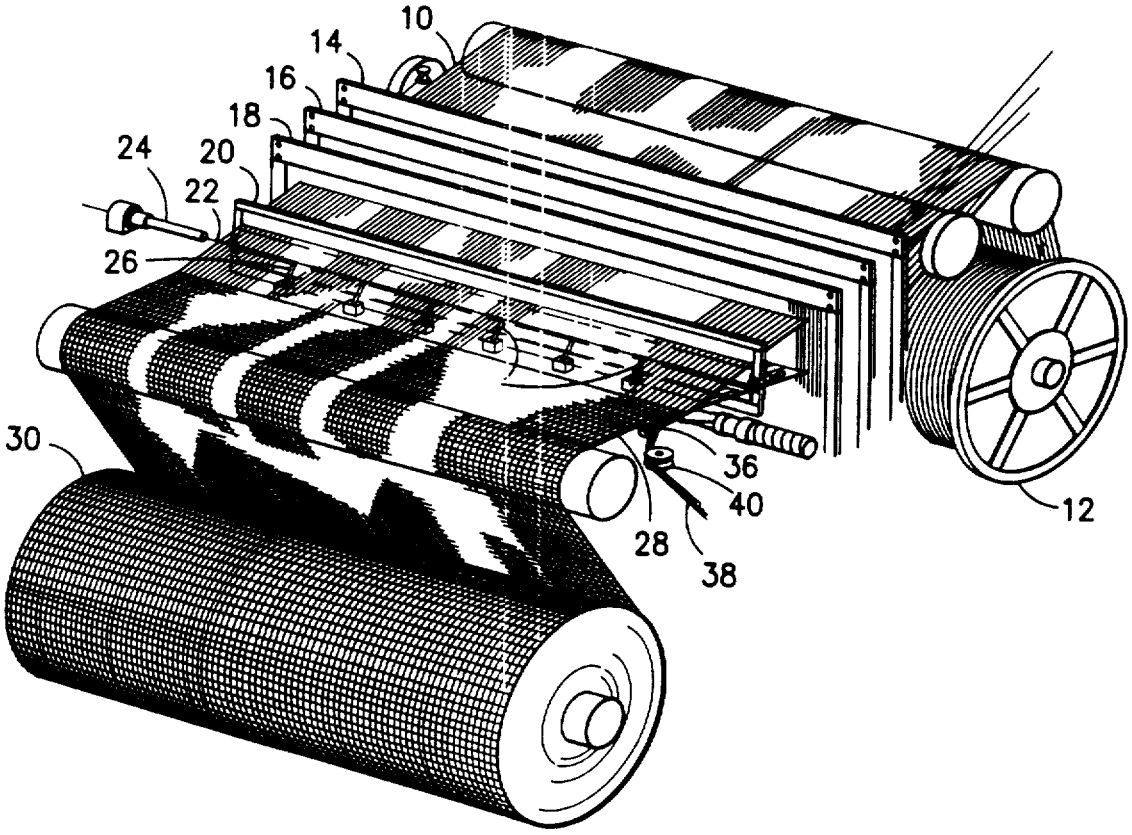
FIG. 1 is a schematic representation of a typical air jet weaving machine.
Figure 2:
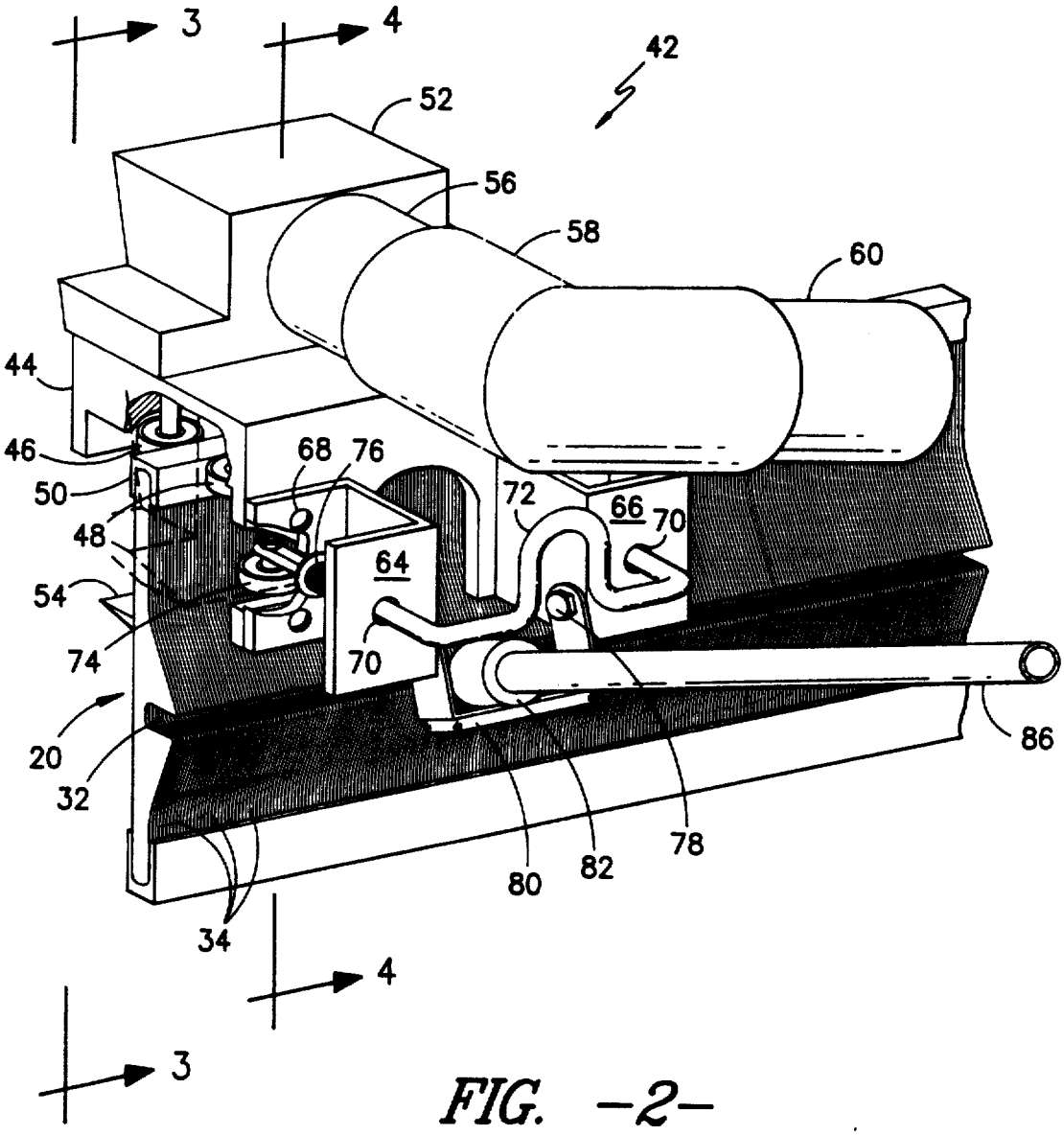
FIG. 2 is a perspective view of a portion of the reed used in the weaving machine of FIG. 1.
Figure 3:
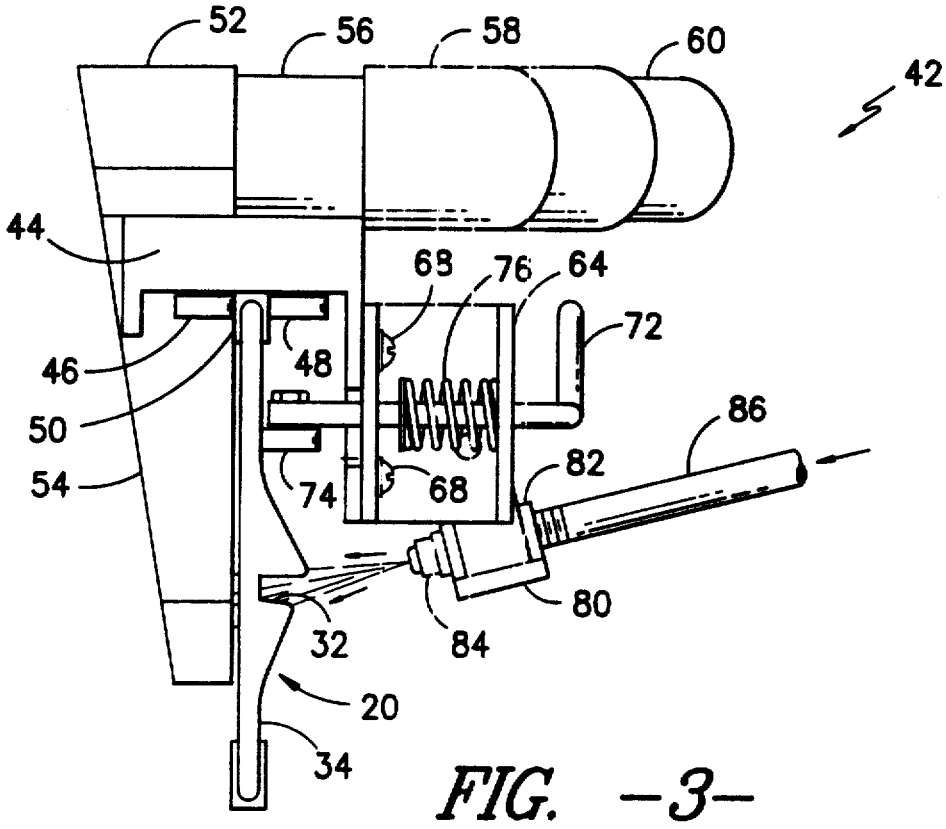
FIG. 3 is a view of the reed cleaning taken on line 3—3 of FIG. 2.
Figure 4:
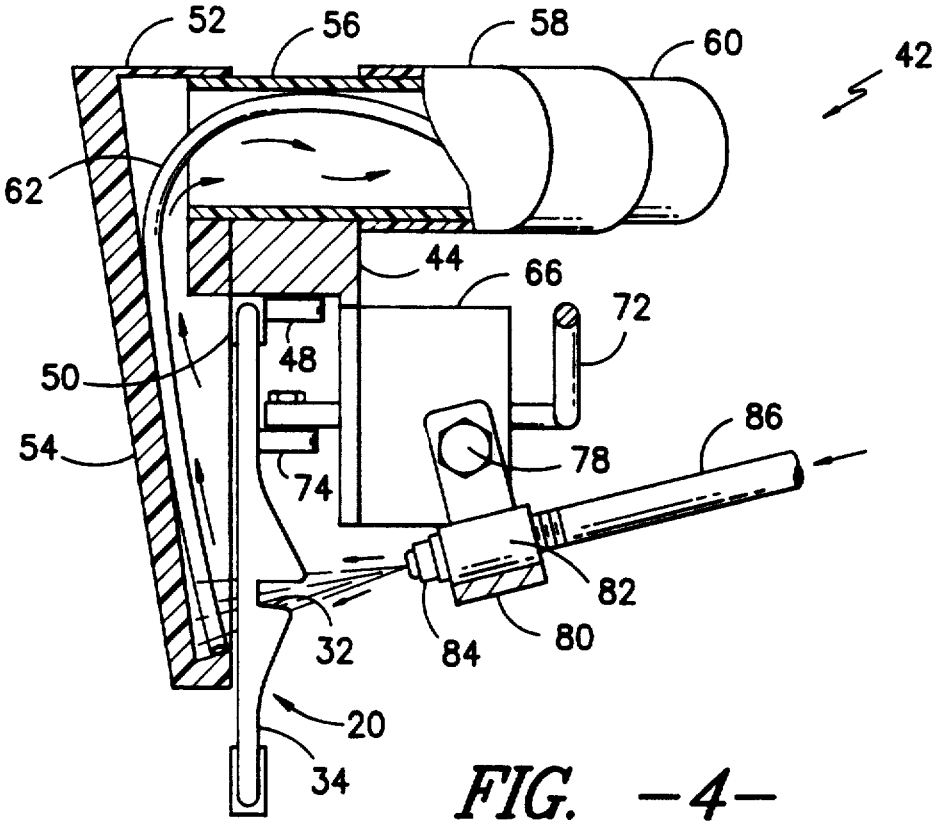
FIG. 4 is a cross-section view of the reed cleaner taken on line 4—4 of FIG. 2.

Looking now to FIG. 1 a typical air jet weaving machine or loom is shown. In typical fashion, warp yarn 10 is supplied from a warp beam 12 through a plurality of harnesses 14, 16 and to the reed 20 through which the fill yarn 22 is projected by the main air nozzle 24. The fill yarn 22 is assisted in its path of travel across the lay of the loom by a series of auxiliary air jets 26. On the beat-up motion, the reed 20 moves the fill yarn 22 into position in the previously formed fabric 28 being taken up on the take-up roll 30.

The reed 20, in typical manner, has a channel or tunnel 32 formed therein by the shape of the dents 34 for the passage of the fill yarn 22 across the loom. At the remote end of the lay across from the main nozzle 24 is a cutter 36 to trim the selvage of the fabric so that the catch cord 38 can be guided away from the loom by the roll 40.

Looking now to FIGS. 2-5 the invention is shown in detail using a cleaning head 42 manufactured from suitable material such as plastic, aluminum, etc. The cleaning head has a U-shaped body portion 44 in which are mounted a plurality of rollers 46 and 48 mounted in pairs spaced from one another in each pair and adapted to contact both sides of the channel section 50 on the top of the reed 20. Mounted on top of the body member 44 is a suction box 52 which has a portion 54 depending therefrom to the apply suction pressure to the back of the reed 20. Connected to the suction box 52 is a plurality of conduits 56, 58 and 60 connected to a suction source (not shown). Also located inside the conduits 56, 58 and 60 is a suction tube 62 to apply localized suction pressure at or below the tunnel 32.

Mounted on the front of the body member 44 is a pair of U-shaped brackets 64 and 66 by any suitable means, such as screws 68. Located in openings 70 in the brackets 64 and 66 is a U-shaped rod member 72 which has a wheel member 74 located at each end thereof. Connected to each arm of the rod member 72 is a compression spring 76 which exerts an outward bias or pressure to place each of the wheels 74 into contact with the face of the reed 20.

Also connected to the brackets 64 and 66 by suitable means such as bolts or screws 78 is a U-shaped bracket member 80. Welded or otherwise secured to the member 80 is a collar 82 which supports an air nozzle 84. The air nozzle 84 is connected by conduit 86 to a source of high pressure air (not shown). The air stream being supplied to the conduit 86 is in the range of 90 p.s.i. to 100 p.s.i. and includes therein an ammonia alcohol based glass cleaner, such as Amtex 418, to enhance the cleaning of the dents.

OPERATION

When it is time to clean the reed of a particular machine or loom the cleaning head 42 is moved to the desired machine or loom and the rod 72 pulled downward against the action of the spring 76. The head 42 is placed over the reed 20 with the wheels 46 and 48 straddling the channel 50 and the rod 72 released to allow the wheel 74 to contact the reed 20. The suction box 52 and the air conduit 86, respectively, are connected to a source of suction pressure and high pressure air. The cleaning head 42 is then slid down the reed 20 and the nozzle 84 blows the air and glass cleaner mixture onto the dents and blows the lint, trash, etc. released from the dents of the reed through the reed where it is picked up by the suction box 52 and the tube 62. The air nozzle 84 is preferably directed towards the tunnel 32 in the reed 20 since this area tends to pick up more lint, etc. and is more critical to the efficient operation of the weaving machine or loom. After the reed 20 has been sufficiently cleaned the rod 72 is depressed and the cleaning head removed from the top of the channel section 50 of the reed 20.

It is obvious that a reed cleaning apparatus and method has been described which will efficiently clean the reed of a weaving machine or loom and which can be readily attached to and detached from the reed of the loom.

Although I have described specifically the preferred embodiments of the invention, it is contemplated that changes may be made without departing from the scope or spirit of the invention and it is desired that the invention be limited only by the scope of the claims.

I claim:

1. A method to clean the reed of a weaving machine without removing the reed from the machine comprising the steps of: Placing a cleaning head on top of the top of the reed, sliding the cleaning head from one end of the reed to the other end of the reed while simultaneously blowing a mixture of a glass cleaner and air at a pressure at or above 90 p.s.i. from the cleaning head through the dents of the reed to dislodge lint, trash, etc. therefrom into a suction apparatus on the opposite side of the reed and sucking the dislodged lint, trash, etc. into the cleaning head for collecting at a point of collection.

2. The method of claim 1 wherein the high pressure air is supplied in the range of 90 p.s.i. to 100 p.s.i.

* * * * *